US005400890A

United States Patent [19]

Gerlier

[11] Patent Number: 5,400,890

[45] Date of Patent: Mar. 28, 1995

[54] DRIVE UNIT FOR A BANKNOTE READER

[76] Inventor: André Gerlier, Hameau de Prailles, F-74140 Sciez, France

[21] Appl. No.: 31,634

[22] Filed: Mar. 12, 1993

[30] Foreign Application Priority Data

Mar. 25, 1992 [CH] Switzerland ..... 00939/92

[51] Int. Cl.[6] ..... G07D 7/00; B65H 29/46

[52] U.S. Cl. ..... 194/206; 271/280

[58] Field of Search ..... 194/206, 207; 271/180, 271/181

[56] References Cited

U.S. PATENT DOCUMENTS

| | | | |
|---|---|---|---|
| 4,011,931 | 3/1977 | Wyckoff | 194/206 |
| 4,997,176 | 3/1991 | Hain | 271/180 |

FOREIGN PATENT DOCUMENTS

| | | | |
|---|---|---|---|
| 0106109 | 9/1983 | European Pat. Off. . | |
| 0260082 | 3/1988 | European Pat. Off. . | |
| 2453811 | 11/1980 | France . | |
| 2619620 | 6/1978 | Germany . | |
| 4005291 | 8/1990 | Germany . | |
| 63-252870 | 10/1988 | Japan | 271/180 |
| 573634 | 3/1976 | Switzerland . | |
| 1470737 | 4/1977 | United Kingdom . | |
| 1510934 | 5/1978 | United Kingdom . | |

*Primary Examiner*—F. J. Bartuska

[57] ABSTRACT

A common drive unit which supplies torque to a conveyor and a stacking device of a sheet reading apparatus, e.g., a banknote reader, comprises at least two motors and two couplings. The conveyor conveys sheets past a testing device installed between an input channel and the stacking device for the recognition of sheet characteristics. A control device decides on the basis of signals received from the testing device on the acceptance or rejection of the tested sheet, and controls the motors and the couplings to effect same. The torque of the two motors is transmitted as required to a drive axle of the conveyor or to a gear box of the stacking device. To convey the sheet to the stacking device, both motors are coupled to the drive axle of the conveyor, while at least the torque of the first motor acts upon the drive axle if the sheet is to be ejected. If the sheet is accepted, the second coupling connects the second motor to the gear box of the stacking device for stacking the sheet.

11 Claims, 2 Drawing Sheets

DRIVE UNIT FOR A BANKNOTE READER

BACKGROUND OF THE INVENTION

The instant invention relates to a drive unit which can be used to drive sheet conveyors in a sheet reading apparatus, for example, a banknote reader.

A drive unit for a vending machine having a banknote reader is known from U.S. Pat. No. 4,011,931. A conveyor belt conveys a banknote from a testing device, which recognizes characteristics of the banknote, either into a device for the stacking of banknotes or, when it is rejected, into a return compartment. The conveyor belt and the banknote stacking device are driven by two independently controlled motors.

The publication Research Disclosure 24820 of Dec. 10, 1984, describes a stacking drive operated by means of a crank shaft which, in contrast to the apparatus of U.S. Pat. No. 4,011,931, requires no reversal of the direction of rotation of the drive motor for stacking.

Banknote readers may be provided with an intermediary cash box as an additional feature, as is known from DE PS 26 19 620, for example. In such banknote readers, the direction of banknote transport must be reversed for the intermediate storing of banknotes.

Furthermore, testing devices to recognize optical and/or magnetic characteristics on sheets or banknotes are also known. See, e.g., the color recognition system described in CH-PS 573 634.

It is an object of the instant invention to provide a low-cost drive unit for a banknote reader which produces high torque and enables rapid intake of banknotes.

SUMMARY OF THE INVENTION

In accordance with the present invention, a drive mechanism is provided for a sheet reading apparatus, such as a banknote reader, the sheet-reading apparatus being equipped with an input channel, a stacking device, a conveyor which conveys a sheet between the input channel and the stacking device, and a testing device which recognizes sheet characteristics and produces signals in response thereto thereby determining whether a sheet inserted into the input channel is to be conveyed to the stacking device for deposit within the sheet reading apparatus, or is to be ejected from the sheet reading apparatus. The inventive drive mechanism is an aggregate which drives both the conveyor and the stacking device and comprises at least two motors and two couplings which transmit torque from the motors to the conveyor and to the stacking device. The two couplings operate in such a way that both motors are coupled to a drive axle of the conveyor for pulling a sheet through the input channel to the stacking device, at least the first motor is coupled to the drive axle of the conveyor for ejecting a sheet, and the second motor is coupled to a gear box of the stacking device.

BRIEF DESCRIPTION OF THE DRAWINGS

Embodiments of the invention are explained in greater detail below through the drawings, in which.

DETAILED DESCRIPTION OF PREFERRED EMBODIMENTS

Figure 1:
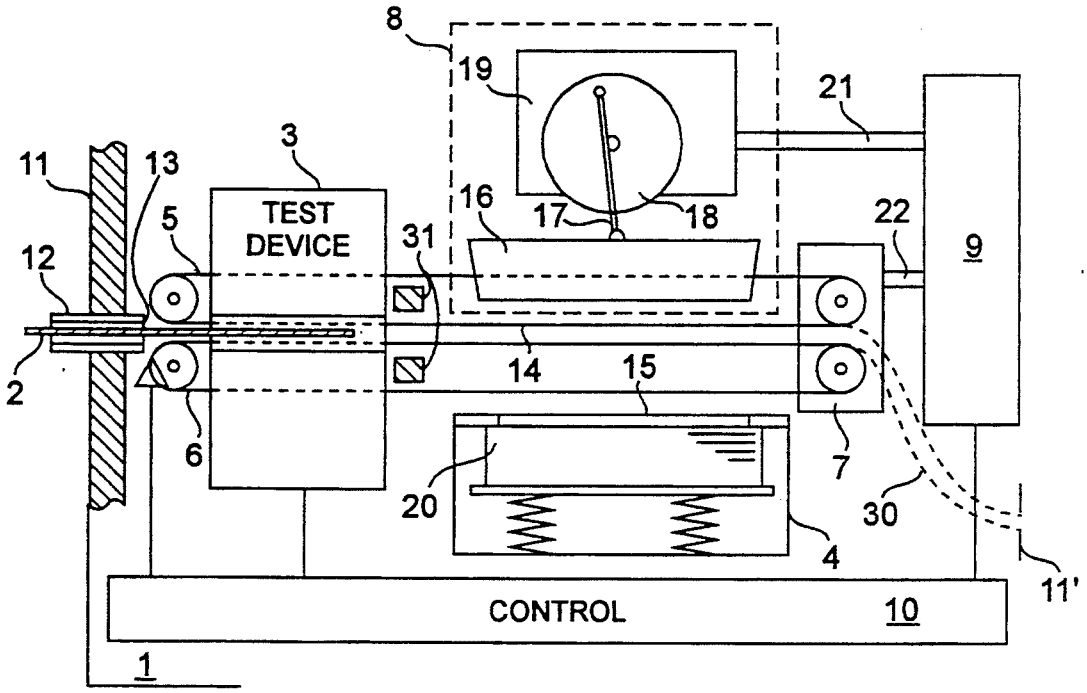
FIG. 1 shows a sheet reading apparatus.

The number 1 in FIG. 1 designates a sheet reading apparatus for sheets 2, 3 designates a testing device, 4 a cassette for stacking the sheets, 5 to 7 components of the conveying means for the sheets, 8 a stacking device, 9 a drive unit, and 10 a control device.

An input channel 12 goes through an outer wall 11 of the sheet reading apparatus 1, its inlet opening 13 guiding a sheet 2 inserted into the input channel 12 between several parallel upper and lower endless belts 5 and 6 of the conveyor. The endless belts 5 and 6 define a conveying path 14 between the inlet opening 13 up to point beyond the cassette 4 which is installed below the conveying path 14. The cassette 4 serves for the deposit of the sheets 2.

The stacking device 8 is installed above the conveying path 14 so as to be located above an opening 15 of the cassette 4. A ram 16 of the stacking device 8 can be lowered by means of a crank mechanism 17 to 19 between the endless belts 5, 6 and into the opening 15. A sheet 2 located in the conveying path 14 above the opening 15 of the cassette 4 can be pushed by means of ram 16 through the opening 15 and onto a stack 20 formed by sheets 2 and can be deposited there as the first sheet of stack 20.

The testing device 3 is provided alongside the conveying path 14 between the inlet opening 13 and the stacking device 8. The testing device is designed to recognize characteristics on sheets 2. Suitable recognizable characteristics may be, for example, the dimensions of the sheets 2, the placement of magnetizable fields, or the color of imprints. The testing device 3 scans a sheet 2 to find the predetermined characteristics and produces pertinent measuring signals.

The drive unit 9 has two outputs, i.e., a drive shaft 21 and a drive axle 22. The drive shaft 21 connects the drive unit 9 to the gear box 19, while the drive axle 22 connects the drive unit 9 to the conveying means 5 to 7. The drive unit 9 produces the torque necessary to drive the endless belts 5, 6 and the stacking device 8. The torque driving the endless belts 5, 6 is transmitted via the drive axle 22 and the gear block 7 of the conveying means to the endless belts 5, 6. The drive shaft 21 drives the stacking device 8 via gear box 19.

The control device 10 is connected via lines to the testing device 3, the drive unit 9, and additional sensors 23, schematically shown in FIG. 1, installed alongside the conveying path 14 which detect the momentary position of the sheet 2. Sensors which are sensitive to light blocking, for example, would be suitable for this.

Figure 2:
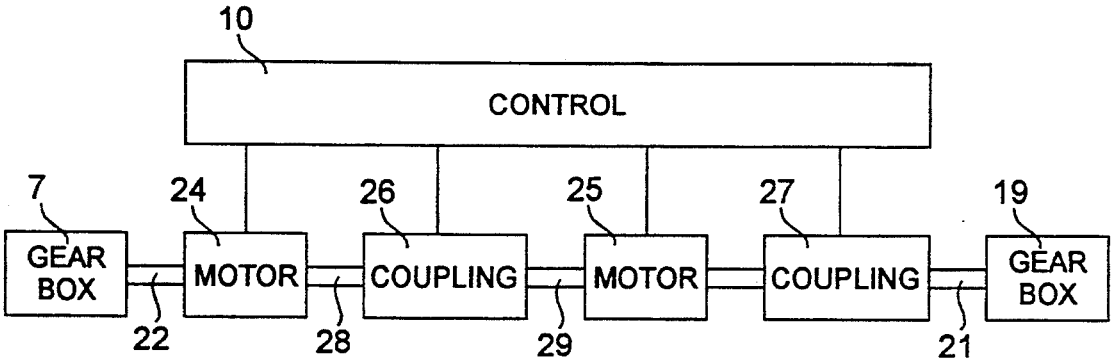
FIG. 2 shows the inventive drive unit for the sheet reading apparatus.

The drive unit 9 combines the necessary motors and couplings in one aggregate. The embodiment according to FIG. 2 is equipped, for instance, with two electric motors 24 and 25 and with two electrically actuated couplings 26 and 27. The motors 24, 25 and the couplings 26, 27 are connected via lines to the control device 10. The electro-mechanical means 24 to 27 is supplied with energy and the necessary control signals over these lines.

A first motor axle 28 of the first motor 24 is connected directly to the drive shaft 22 of the gear block 7. A second motor axle 29 of the second motor 25 can be connected to the first motor axle 28 by means of the first coupling 26 so that both motors 24 and 25 can jointly drive the endless belts 5, 6. The torque of the second motor 25 on the drive shaft 21 can also be transmitted via a second coupling 27 to the gear box 19. The motors 24, 25 can be switched on independently of each other, their directions of rotation can be reversed, and they feature the states "OFF" "+" and "−". The "+" designates one direction of motor rotation, and the "−" designates the opposite direction of rotation.

The couplings 26 and 27 transmit torque only when they receive a signal for this from the control device 10 and are thus actuated. The couplings 26, 27 are advantageously designed to limit the torque to be transmitted so that damage may be avoided, e.g., damage to a sheet 2 which is not being conveyed in a regular fashion (FIG. 1). If the reading apparatus 1 is in readiness or rest position, the two couplings 26, 27 are disconnected. In the operating state of the reading apparatus 1, only one of the two couplings 26, 27 at a time or neither is connected.

If a user of the reading apparatus 1 (FIG. 1) pushes the sheet 2 through the input channel 12 (FIG. 1) into the reading apparatus 1, the presence of the forward edge of the sheet 2 is detected at the input of the conveying means 5, 6 (FIG. 1) by one of the sensors 23 (FIG. 1) and is indicated to the control device 10. The reading apparatus 1 is then put in the operating state.

The control device 10 engages the first coupling 26 and the two motors 24, 25, whereby the latter run in the same direction of rotation. The sum of the torques of the two motors 24, 25 acts jointly upon the drive axle 22 and starts the conveying means 5, 6 moving so that the sheet 2, as soon as it is seized by the conveying means 5, 6, can be pulled in at great speed through the input channel 12 into the reading apparatus 1 thanks to the sum of torques of both motors 24, 25.

The testing device 3 (FIG. 1) scans the sheet 2 conveyed into the conveying path 14 (FIG. 1) for predetermined characteristics and decides after a comparison of the measured values with set values stored in the testing device 3 whether the sheet 2 is to be accepted and deposited on the stack 20 (FIG. 1), or whether it should be refused and returned by being ejected from the sheet reading apparatus 1.

If the sheet 2 is to be refused because it does not meet the requirements established by the set values, the direction of rotation of the endless belts 5, 6 is reversed so that the sheet 2 goes back out again through the input channel 12. As an advantage of the electrically controlled couplings 26, 27, the torque of the two motors 24 and 25 is also available for rapid conveying of the sheet 2 back in the direction of the input channel 12.

In another embodiment, the sheet 2 is advantageously conveyed along the intake direction past the stacking device 8 (FIG. 1) until said sheet 2 is returned to the user through an ejection channel 30 (FIG. 1) in the wall 11' (FIG. 1) of the reading apparatus 1 in order to avoid stopping and reversing the conveying direction of sheet 2.

If sheet 2 is to be accepted, i.e., to be cashed, the control device 10 aligns said sheet 2 by means of the sensors 23 along the conveying path 14 precisely over stack 20 and disengages the motors 24, 25 and the first coupling 26. Following this, the second coupling 27 is engaged so that when the second motor 25 is switched on, it can transmit its torque by means of the drive shaft 21 to the gear box 19 of the stacking device 8 (FIG. 1). The operating program of the second motor 25 is determined by the stacking device 8.

One advantage of the described drive unit is its low structural height due to the fact that the sum of the torques of the two motors 24, 25 is available to pull in sheet 2. The dimensions of a single motor with sufficient torque to pull in the sheet 2 would be greater than that of the two motors 24, 25 which together produce the same amount of torque. The sheet 2 can thus be drawn in at greater speed and, in addition to affording the possibility of rapidly inserting several sheets 2 one after the other, this also renders undesirable manipulations during input more difficult.

If the reading apparatus 1 is able to recognize the sheets 2 of a predetermined set of different dimensions or in particular banknotes of different denominations, the sheets 2 can be deposited in different cassettes 4 with stacking devices 8 dedicated according to their predetermined characteristics and in accordance with the recognition signals received from the testing device 3.

Since only one stacking device 8 at a time is actuated by the control device 10, each stacking device 8 may be driven by the second motor 25 via a suitable coupling 27 assigned to the corresponding stacking unit 8.

Figure 3:
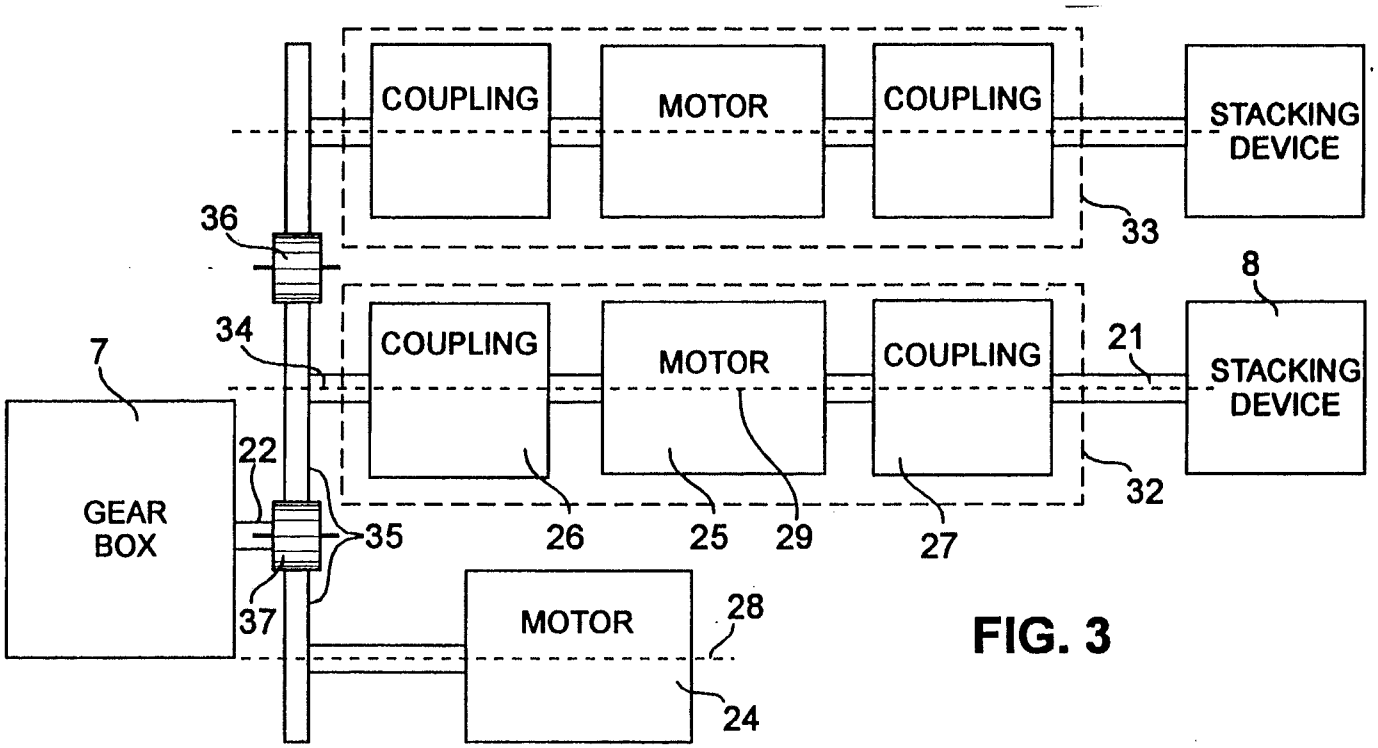
FIG. 3 shows a second embodiment of the drive unit.

In the drawing of FIG. 1, two hatch-marked surfaces are shown as an example, these surfaces being available as spaces 31 for the installation of the drive unit 9 shown in FIG. 3. The drive unit 9 shown in FIG. 3 is designed for very limited available space and is especially well suited for installation in a space 31 inside one of the loops formed by the endless belts 5 or 6. A partial aggregate 32 or 33 (see FIG. 3) is provided for each stacking device 8. The partial aggregates 32 and 33 comprise the second motor 25 and the two couplings 26 and 27. The first motor 24 drives the gear block 7 directly, while the aggregates 32 and 33 with the output axles 34 of each first coupling 26 are engaged to the gear block 7. A coupling via gear wheels 35 and pinion gears 36, 37 is shown here. All motor axles 28, 29 are parallel in relation to each other.

Figure 4:
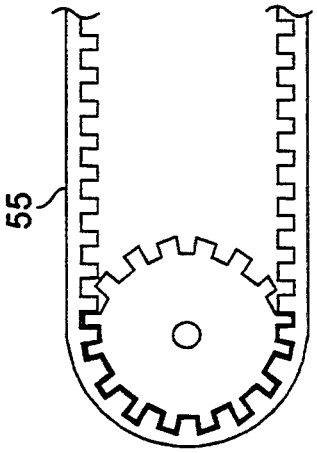
FIG. 4 shows a cross-sectional view of a portion of a toothless endless belt.

An especially economic coupling for the endless belts 5, 6 (FIG. 1) is possible if these are made in the form of toothed belts, such as shown in FIG. 4. The gear block 7 can be reduced to gear wheels installed on the drive axle 22 which engage one of the endless belts 5 or 6 directly. The other endless belt is driven by friction along the conveying path 14 (FIG. 1) by the toothed belts.

The construction of the drive unit can be especially simple if the couplings 26, 27 are controlled purely mechanically. The torque will then be transmitted as a function of the direction of rotation and/or of the rotational speed of the second motor 25. For example, the drive unit can be arranged so that the second motor 25 will transmit its torque only to the drive axle 22 via the first coupling 26 when it rotates in the "+" direction, and only to the gear box 19 via the second coupling 27 when it rotates in the "−" direction. Couplings 26, 27 such as free running couplings with pawl and ratchet wheels as well as centrifugal couplings require no external electrical control and this simplifies the drive unit 9 and the control device 10 advantageously. To drive the stacking device 8, only one direction of rotation of the drive shaft 21 can be used, however, e.g., the device known from the Research Disclosure mentioned initially can be used, for example. Also, in this embodiment the return of the sheet 2 via input channel 12 (FIG. 1) can only be effected with the torque of the first motor 24.

Instead of the endless belts 5, 6 it is also possible to use an arrangement of conveyor rollers or several endless belt sections or a combination thereof.

While the invention has been described by reference to specific embodiments, this was for purposes of illustration only. Numerous alternative embodiments will be apparent to those skilled in the art and are considered to be within the scope of the invention.

It is claimed:

1. A drive mechanism for a sheet reading apparatus having an input channel, a stacking device, conveying means for conveying a sheet on a conveying path between said input channel and said stacking device, and a testing device disposed along said conveying path between said input channel and said stacking device for recognizing sheet characteristics and thereby determining whether a sheet inserted into said input channel is to be conveyed to said stacking device for deposit in said sheet reading apparatus or ejected from said sheet reading apparatus, said drive mechanism comprising a common drive unit which drives both said conveying means and said stacking device, said drive unit being an aggregate comprising at least first and second motors and at least first and second couplings which transmit torque produced by said first and second motors, said first and second couplings being arranged so that both said first and second motors are coupled to a drive axle of said conveying means for pulling a sheet through an input opening of said inlet channel and conveying it to said stacking device, at least said first motor is coupled to said drive axle of said conveying means for ejecting a sheet, and at least said second motor is coupled to a gear box of said stacking device for stacking a sheet.

2. The drive mechanism of claim 1 wherein said first motor is connected directly to said drive axle of said conveying means, said first coupling is located between said first and second motors, said second coupling is located between said second motor and said gear box of said stacking device, and torque produced by said second motor is transmitted via only one of said first and second couplings at any particular time.

3. The drive mechanism of claim 2 wherein said first coupling is arranged to couple said second motor to said drive axle of said conveying means for ejecting a sheet.

4. The drive mechanism of claim 2 wherein said first and second couplings are arranged so that said first coupling transmits torque from said second motor to said drive axle of said conveying means when said second motor rotates in a first direction of rotation, and said second coupling transmits torque from said second motor to said gear box of said stacking device when said second motor rotates in a second direction of rotation.

5. The drive mechanism of claim 1 wherein said first and second motors are installed in said sheet reading apparatus next to each other and with parallel output axles.

6. The drive mechanism of claim 5, wherein said conveying means comprises first and second endless belts disposed opposite each other and said first and second motors are located within a loop formed by one of said first and second endless belts.

7. The drive mechanism of claim 6 wherein at least one of said first and second endless belts comprises a toothed belt engaged by said drive axle, said first and second motors being located within the loop formed by said toothed belt.

8. The drive mechanism of claim 1 wherein said first and second motors are disposed one behind another on a common axle.

9. The drive mechanism of claim 1 wherein said sheet reading apparatus further comprises a central control device connected to said testing device, to said first and second couplings, and to said first and second motors, wherein said control device processes signals received from said testing device and emits an acceptance or rejection signal to said first and second couplings and to said first and second motors thereby to effect acceptance or rejection of a sheet in said sheet reading apparatus.

10. The drive mechanism of claim 1 wherein said first and second couplings are purely mechanical device and effect transmission of torque from said first and second motors based on the direction of rotation of said second motor.

11. The drive mechanism of claim 1 wherein said first and second couplings are purely mechanical devices and effect transmission of torque from said first and second motors based on the rotational speed of said second motor.

* * * * *